US011262127B2

(12) United States Patent
Kato et al.

(10) Patent No.: US 11,262,127 B2
(45) Date of Patent: Mar. 1, 2022

(54) COATING DRYING METHOD AND DEVICE THEREFOR

(71) Applicant: MAZDA MOTOR CORPORATION, Hiroshima (JP)

(72) Inventors: Hidekazu Kato, Hiroshima (JP); Hiroki Matsui, Kosai (JP); Toshihiro Yoshida, Higashihiroshima (JP); Naoto Waku, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 316 days.

(21) Appl. No.: 16/464,845

(22) PCT Filed: Nov. 24, 2017

(86) PCT No.: PCT/JP2017/042295
§ 371 (c)(1),
(2) Date: May 29, 2019

(87) PCT Pub. No.: WO2018/101178
PCT Pub. Date: Jun. 7, 2018

(65) Prior Publication Data

US 2019/0323772 A1 Oct. 24, 2019

(30) Foreign Application Priority Data

Nov. 30, 2016 (JP) ..... JP2016-232366

(51) Int. Cl.
*F26B 21/08* (2006.01)
*F25B 9/00* (2006.01)
(Continued)

(52) U.S. Cl.
CPC ..... *F26B 21/086* (2013.01); *F25B 9/008* (2013.01); *F26B 21/04* (2013.01); *F26B 21/10* (2013.01); *F26B 23/005* (2013.01); *F26B 25/06* (2013.01)

(58) Field of Classification Search
CPC ..... F26B 21/086; F26B 21/04; F26B 21/10; F26B 23/005; F26B 25/06; F26B 21/02; F26B 25/006; F25B 9/008
(Continued)

(56) References Cited

U.S. PATENT DOCUMENTS 7,566,409 B1 7/2009 Zastrow et al.
9,803,313 B2 * 10/2017 Ryoo ..... D06F 58/02
(Continued)

FOREIGN PATENT DOCUMENTS

CA 2113807 A1 2/1993
CA 2269982 A1 5/1998
(Continued)

OTHER PUBLICATIONS

International Search Report issued in PCT/JP2017/042295; dated Feb. 20, 2018.

*Primary Examiner* — Jorge A Pereiro
*Assistant Examiner* — Bao D Nguyen
(74) *Attorney, Agent, or Firm* — Studebaker & Brackett PC

(57) ABSTRACT

Air is taken out from a drying oven 1 for drying a coating film of a work piece 2, and the air is cooled such that each of at least part of moisture and at least part of a VOC which are contained in the air is condensed to be removed from the air. The air after the cooling is heated, and is returned into the drying oven 1. A heat pump 3 whose heat absorption source is the air taken out from the drying oven 1 and whose heat radiation source is the air after the cooling is provided.
(Continued)

By using the heat pump 3, cooling and heating of the air are performed.

10 Claims, 4 Drawing Sheets

(51) Int. Cl.
*F26B 21/04* (2006.01)
*F26B 21/10* (2006.01)
*F26B 23/00* (2006.01)
*F26B 25/06* (2006.01)

(58) Field of Classification Search
USPC ..... 34/427
See application file for complete search history.

(56) References Cited

U.S. PATENT DOCUMENTS

2002/0038521 A1 4/2002 Speck
2006/0086120 A1* 4/2006 Kashirajima ..... F24F 12/003 62/271

FOREIGN PATENT DOCUMENTS

| | | | | |
|---|---|---|---|---|
| CA | 2 969 859 | A1 | | 6/2016 |
| CN | 101487662 | A | | 7/2009 |
| CN | 101504247 | A | | 8/2009 |
| JP | S58-130983 | A | | 8/1983 |
| JP | H05-277421 | A | | 10/1993 |
| JP | H06-509268 | A | | 10/1994 |
| JP | H07-004845 | A | | 1/1995 |
| JP | 2009-022856 | A | | 2/2009 |
| JP | 2011-058081 | A | | 3/2011 |
| JP | 2011058081 | A | * | 3/2011 |
| JP | 2011-088052 | A | | 5/2011 |
| JP | 2011088052 | A | * | 5/2011 |
| KR | 10-2011-0068615 | A | | 6/2011 |
| WO | 98/019124 | A1 | | 5/1998 |
| WO | 2010/044392 | A1 | | 4/2010 |

* cited by examiner

COATING DRYING METHOD AND DEVICE THEREFOR

TECHNICAL FIELD

The present invention relates to a coating drying method for drying a coating film of a coated work piece and a device therefor.

BACKGROUND ART

A coated work piece is conveyed into a drying oven and drying (flash-off or baking) of a coating film thereof is performed generally in the field of vehicle body coating or the like. Patent Document 1 discloses one example of a baking drying oven for a vehicle body having undergone electrodeposition coating. In this example, outside air conducted from an outside air inlet passage and air taken out from a drying oven are mixed, the mixed air is heated by a heater, and the heated air is supplied to the drying oven. In addition, exhaust gas (exhaust gas including tar components) from the drying oven is conducted into a catalytic oxidizer, is subjected to clarification and deodorization processing, and the processed exhaust gas is discharged to the atmosphere. Further, the above-mentioned conducted outside air is preheated by high temperature exhaust gas that has undergone the clarification and deodorization processing.

In addition, Patent Document 1 further discloses that a preheating oven and a cooling zone are provided ahead of and behind the drying oven, respectively, and heating of air for preheating and cooling of air for cooling are performed by a heat pump whose heat radiation source is the air for preheating and whose heat absorption source is the air for cooling.

CITATION LIST

Patent Document

PATENT DOCUMENT 1: Japanese Unexamined Patent Publication No. 2011-58081

SUMMARY OF THE INVENTION

Technical Problem

In the above-mentioned drying oven, a vapor pressure inside the drying oven is increased by evaporation of moisture and a volatile organic compound (VOC) which are contained in the coating film and in association therewith, an evaporation rate is decreased (the drying takes time), which poses a problem.

In addition, in order to process (combust and decompose) the VOC by the catalytic oxidizer, energy is required. Further, although heat of the exhaust gas having passed through the catalytic oxidizer is utilized for heating of the conducted outside air by heat exchange, since a temperature of the exhaust gas is comparatively high even after the heat exchange, an energy loss is caused by discharging thereof.

Further, air leaks from the drying oven to the cooling zone, and the tar components condense and adhere to the work piece, which also poses a problem.

Solution to the Problem

In order to solve the above-described problems, in the present invention, air taken out from a drying oven is cooled by a heat pump, vapor of moisture, a VOC, and the like which are contained in the air are condensed and removed, and thereafter, the air is heated and returned to the drying oven.

A coating drying method disclosed herein is a method for conveying a coated work piece into a drying oven and drying a coating film of the work piece in the drying oven, the method including: taking out air from the drying oven, and cooling the air such that each of at least part of moisture and at least part of a VOC which are contained in the air is condensed to be removed from the air; heating the air after the cooling, and returning the heated air into the drying oven, and a heat pump whose heat absorption source is the air taken out from the drying oven and whose heat radiation source is the air after the cooling is provided, and by using the heat pump, the cooling of the air and the heating of the air are performed.

According to this, since the air inside the drying oven is taken out and is cooled, the moisture and the VOC are condensed and removed, and thereafter, the dried air is heated and is returned into the drying oven, a vapor pressure inside the drying oven is inhibited from rising. As a result, since evaporation rates of the moisture and the VOC contained in the coating film in the drying oven become high, the coating film of the work piece can be quickly and efficiently dried in the drying oven, thereby exhibiting advantage in enhancement of quality.

In addition, since the VOC is removed by the above-mentioned cooling, exhausting for processing of the VOC and installation of a catalytic oxidizer are not required, or even when the catalytic oxidizer is installed, downsizing of the catalytic oxidizer and reduction in an exhaust amount are enabled. Further, since the heat pump is used for the cooling and the heating of the air, an energy loss is decreased. Thus, advantage in energy saving is exhibited.

In addition, since tar components are condensed and removed by the above-mentioned cooling, adhesion of the tar components onto the work piece, caused by leakage of the tar components, can be prevented.

In one embodiment, the heat pump includes a plurality of the heat pumps, and by using the plurality of heat pumps, the cooling of the air and the heating of the air are performed in a stepwise manner.

In a single-step cooling, it is difficult to lower a temperature of the air taken out from the drying oven up to a temperature at which the moisture and the VOC are condensed. However, according to the above-described embodiment, since by using the plurality of heat pumps, the cooling and the heating of the air are performed in the stepwise manner, it is facilitated that the air is cooled so as to have a desired temperature and subsequently, the temperature is increased up to a temperature suited for drying of the coating film of the work piece.

In one embodiment, as the plurality of heat pumps, a first heat pump whose refrigerant is $CO_2$, and a second heat pump whose refrigerant is a chlorofluorocarbon medium are provided, and the cooling of the air is performed in the stepwise manner first by the first heat pump and next by the second heat pump, and the heating of the air is performed in the stepwise manner first by the second heat pump and next by the first heat pump.

The first heat pump whose refrigerant is $CO_2$ is suited for heat absorption and radiation on a high temperature side and the second heat pump whose refrigerant is the chlorofluorocarbon medium is suited for heat absorption and radiation on a low temperature side. Therefore, the cooling of the air is performed in the stepwise manner first by the first heat pump and next by the second heat pump and the heating of the air is performed in the stepwise manner first by the second heat pump and next by the first heat pump.

In one embodiment, the air taken out from the drying oven is preliminarily cooled before the cooling by the heat pump.

In the cooling by the heat pump, heat is generated in association with, e.g., driving of a compressor or the like. However, according to the above-described embodiment, the preliminary cooling facilitates the cooling of the air by the heat pump so as to have the desired temperature.

In one embodiment, the air heated by the heat pump is further heated, and is returned into the drying oven.

The air heated by the heat pump is further heated, thereby facilitating adjustment of the temperature of the air returned into the drying oven so as to have the desired temperature.

In one embodiment, the work piece is mounted on a conveyance hanger, and is conveyed into the drying oven, and in the cooling of the air, the moisture contained in the air taken out from the drying oven is condensed to be removed from the air such that a dew-point temperature of the air inside the drying oven becomes equal to or less than a surface temperature of the hanger to be conveyed into the drying oven.

Thus, dew condensation on the hanger inside the drying oven is prevented, and as a result, quality degradation of the coating film, caused by dropping of dew condensation water to the work piece, can be avoided.

A coating drying device disclosed herein for drying a coating film of a coated work piece, includes: a drying oven into which the work piece is conveyed; a cooler into which air from the drying oven is conducted, and which cools the air such that at least part of moisture and at least part of a VOC which are contained in the air are condensed to be removed; a heater into which the air after the cooling by the cooler is conducted, and which heats the air; a circulation path which circulates the air inside the drying oven so as to pass from the cooler through the heater and to be returned into the drying oven; and a heat pump which connects the cooler and the heater together, the heat pump supplying cold heat, cooling the air, to the cooler by heat exchange, and which supplies hot heat, heating the air, to the heater by heat exchange.

By employing this device, the air can be taken out from the drying oven, the air is cooled by the heat pump such that each of at least part of moisture and at least part of the VOC contained in the air is condensed to be removed, and further, by using the heat pump, the air after the cooling can be heated and returned into the drying oven. Thus, the vapor pressure inside the drying oven is inhibited from rising, thereby allowing the coating film of the work piece to be quickly and efficiently dried, and the exhausting for processing of the VOC and the installation of the catalytic oxidizer are not required, or the downsizing of the catalytic oxidizer and the reduction in the exhaust amount can be made, thereby exhibiting the advantage in the energy saving and further, preventing the adhesion of the tar components onto the work piece, caused by the leakage of the tar components.

In one embodiment of the coating drying device, a plurality of sets are provided in the circulation path so as to cause the cooling of the air and the heating of the air to be performed in a stepwise manner, each of the plurality of sets being formed by connecting the cooler and the heater together other by the heat pump.

According to this, it is facilitated that the air taken out from the drying oven is cooled so as to have a desired temperature and subsequently and the temperature is increased up to a temperature suited for drying of the coating film of the work piece.

The coating drying device in one embodiment includes, as the plurality of sets, a first set configured as a first heat pump whose refrigerant is $CO_2$ and a second set configured as a second heat pump whose refrigerant is a chlorofluorocarbon medium, wherein both of the first and second sets are provided in the circulation path so as to cause the cooling of the air to be performed in the stepwise manner first by the first heat pump and next by the second heat pump and to cause the heating of the air to be performed in the stepwise manner first by the second heat pump and next by the first heat pump.

According to this, the first heat pump whose refrigerant is the $CO_2$ suited for heat absorption and radiation on a high temperature side and the second heat pump whose refrigerant is the chlorofluorocarbon medium suited for heat absorption and radiation on a low temperature side are used, thereby allowing the cooling and the heating of the air to be efficiently performed.

The coating drying device in one embodiment includes an anterior cooler provided in the circulation path, cooling the air taken out from the drying oven, and then, conducting the air into the cooler.

According to this, the cooling of the air by the heat pump so as to have the desired temperature is facilitated by the preliminary cooling performed by the anterior cooler.

The coating drying device in one embodiment includes a posterior heater provided in the circulation path, further heating the air after the heating, and returning the heated air into the drying oven.

Adjustment of the temperature of the air returned into the drying oven so as to have the desired temperature is facilitated by the heating performed by the posterior heater. In addition, temperature rising in the drying oven upon starting operation can be hastened by the posterior heater.

In the one embodiment of the coating drying device, the work piece is mounted on a conveyance hanger, and is conveyed into the drying oven, and the cooler condenses the moisture contained in the air taken out from the drying oven to be removed from the air such that a dew-point temperature of the air inside the drying oven becomes equal to or less than a surface temperature of the hanger to be conveyed into the drying oven.

Thus, dew condensation on the hanger inside the drying oven is prevented, and as a result, quality degradation of the coating film, caused by dropping of dew condensation water to the work piece, can be avoided.

Advantages of the Invention

According to the present invention, since by using the heat pump, the air taken out from the drying oven is cooled, each of the at least part of moisture and at least part of the VOC is condensed and removed, and the air after the cooling is heated and returned into the drying oven, the vapor pressure inside the drying oven is inhibited from rising, thereby allowing the coating film of the work piece to be quickly and efficiently dried, and the exhausting for processing of the VOC and the installation of the catalytic oxidizer are not required, or the downsizing of the catalytic oxidizer and the reduction in the exhaust amount can be made, thereby exhibiting the advantage in the energy saving and further, preventing the adhesion of the tar components onto the work piece, caused by the leakage of the tar components.

DESCRIPTION OF EMBODIMENTS

Hereinafter, embodiments of the present invention will now be described with reference to the accompanying drawings. The following description of the preferred embodiments is only an example in nature, and is not intended to limit the scope, applications, or use of the present invention.

First Embodiment

Figure 1:
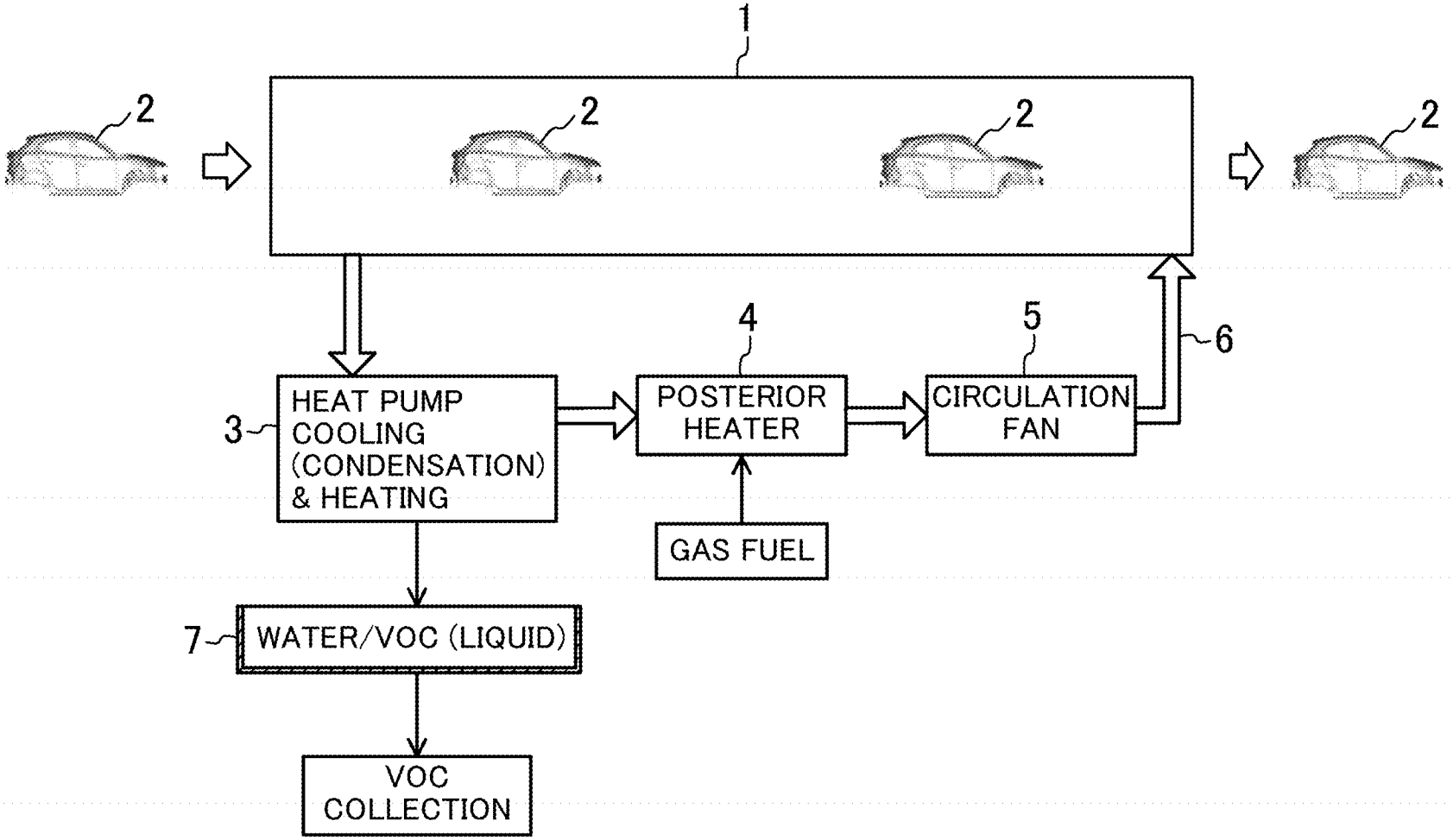
FIG. 1 is a block diagram illustrating a coating drying device according to a first embodiment.

In a coating drying device shown in FIG. 1, a reference number 1 indicates a drying oven into which a coated work piece 2 is conveyed. Outside the drying oven 1, a heat pump 3 for cooling air taken out from the drying oven 1 and thereafter, heating the air; a posterior heater 4 for heating the air heated by the heat pump 3; and a circulation fan 5 are provided. The drying oven 1, the heat pump 3, the posterior heater 4, and the circulation fan 5 are connected by a circulation path 6 which circulates the air taken out from the drying oven 1 through the heat pump 3, the posterior heater 4, and the circulation fan 5 in this order and returns the air into the drying oven 1.

The heat pump 3 is of a vapor compression type which circulates a refrigerant through a compressor, a condenser, an expansion valve, and an evaporator in this order with $CO_2$ used as the refrigerant. The evaporator of the heat pump 3 constitutes a cooler for cooling the air taken out from the drying oven 1 by heat exchange so as to allow at least part of moisture and at least part of a VOC which are contained in the air to be condensed and removed. In addition, the condenser of the heat pump 3 constitutes a heater for heating the air cooled by the above-mentioned evaporator by heat exchange. In other words, the heat pump 3 is a heat pump whose heat absorption source is the air taken out from the drying oven 1 and whose heat radiation source is the above-mentioned air after the cooling.

As the posterior heater 4, a gas burner is used, and a gas fuel and outside air are supplied to the posterior heater 4. This posterior heater 4 is utilized in accordance with the necessity of, e.g., early temperature rising of air inside the drying oven 1 upon starting operation, and adjustment of a temperature inside the drying oven 1.

Figure 2:
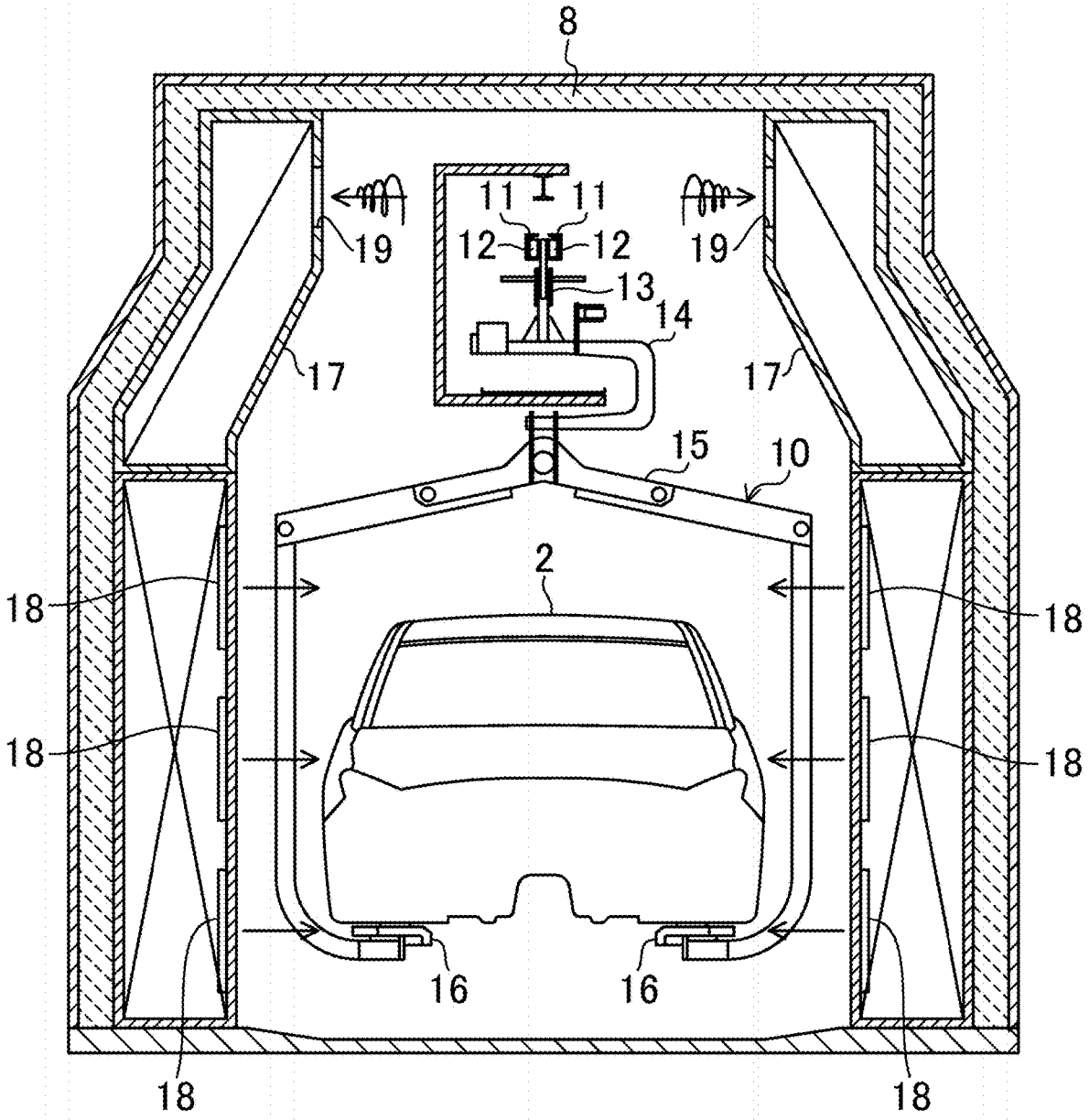
FIG. 2 is a cross-sectional view illustrating a drying oven, a work piece, and a conveyance hanger in the coating drying device.

The work piece 2 in the present example is an automobile body, is mounted on a hanger 10 which is a hanger type conveyance apparatus (overhead conveyer) shown in FIG. 2, and is conveyed into the drying oven 1.

The hanger type conveyance apparatus includes guide rails 11 which extend along a coating line and a front and rear trolley 13 which engages with the guide rails 11 by rollers 12 and moves along the guide rails 11, and the hanger 10 is suspended on the trolley 13. The hanger 10 includes a front and rear gate-shaped frame 15, for supporting the work piece 2 from both sides thereof, which is suspended on the trolley 13 via a C-neck 14. On lower end portions of the gate-shaped frame 15, work piece receivers 16 are provided.

On inner side walls 17 of the drying oven 1, which face each other, nozzle boxes 18 which blow out hot air supplied from the circulation path 6 toward the work piece 2 mounted on the hanger 10 are provided. On upper portions of the inner side walls 17, air suction ports 19 open, the air suction ports 19 discharging air inside the drying oven 1 to the circulation path. On a wall of the drying oven 1, a heat insulating material 8 is provided.

In the above-described configuration, the coated work piece 2 is mounted on the hanger 10 and is conveyed into the drying oven 1. In the drying oven 1, while the work piece 2 is being conveyed, drying of a coating film of the work piece 2 is performed. The air inside the drying oven 1 is conducted from the air suction ports 19 to the evaporator (cooler) of the heat pump 3 by operation of the circulation fan 5 and is cooled by the evaporator.

Thus, part of moisture contained in the air taken out from the drying oven 1 condenses. Concurrently, the VOC contained in the air and tar components generated by, e.g., oxidative decomposition of coating components also partly condense. A condensate liquid produced by cooling of this air is stored in a tank 7. The VOC is collected from this condensate liquid in the tank 7, and is reused.

The air after the cooling, whose moisture, VOC, and the like are removed, is conducted to the condenser (heater) of the heat pump 3, and is heated by the condenser. The air heated by the condenser is further heated by the posterior heater 4 as needed, and is returned from the nozzle boxes 18 of the drying oven 1 to the inside of the drying oven 1. In other words, the hot air is blown out into the drying oven 1.

As described above, the air taken out from the drying oven 1 is cooled by the heat pump 3, thereby removing not only part of the moisture contained in the air but also part of the VOC. Therefore, the coating drying device does not have to be provided with exhaust equipment for taking out the air inside the drying oven 1 and combusting, and removing, the VOC by a catalyst combustion apparatus.

In this way, the air from which the moisture has been removed and whose humidity has become low, i.e., the dried hot air is supplied to the drying oven 1. Therefore, in the drying oven 1, evaporation rates of the moisture and the VOC from the coating film of the work piece 2 become high, thereby making it possible to quickly dry the coating film and to enhance quality. In addition, the dried hot air is supplied to the drying oven 1, thereby lowering a dew-point temperature of the air in the drying oven 1 and avoiding dew condensation onto the hanger 10. This can avoid quality degradation of the coating film, caused by dropping of dew condensation water to the work piece 2.

Second Embodiment

Figure 3:
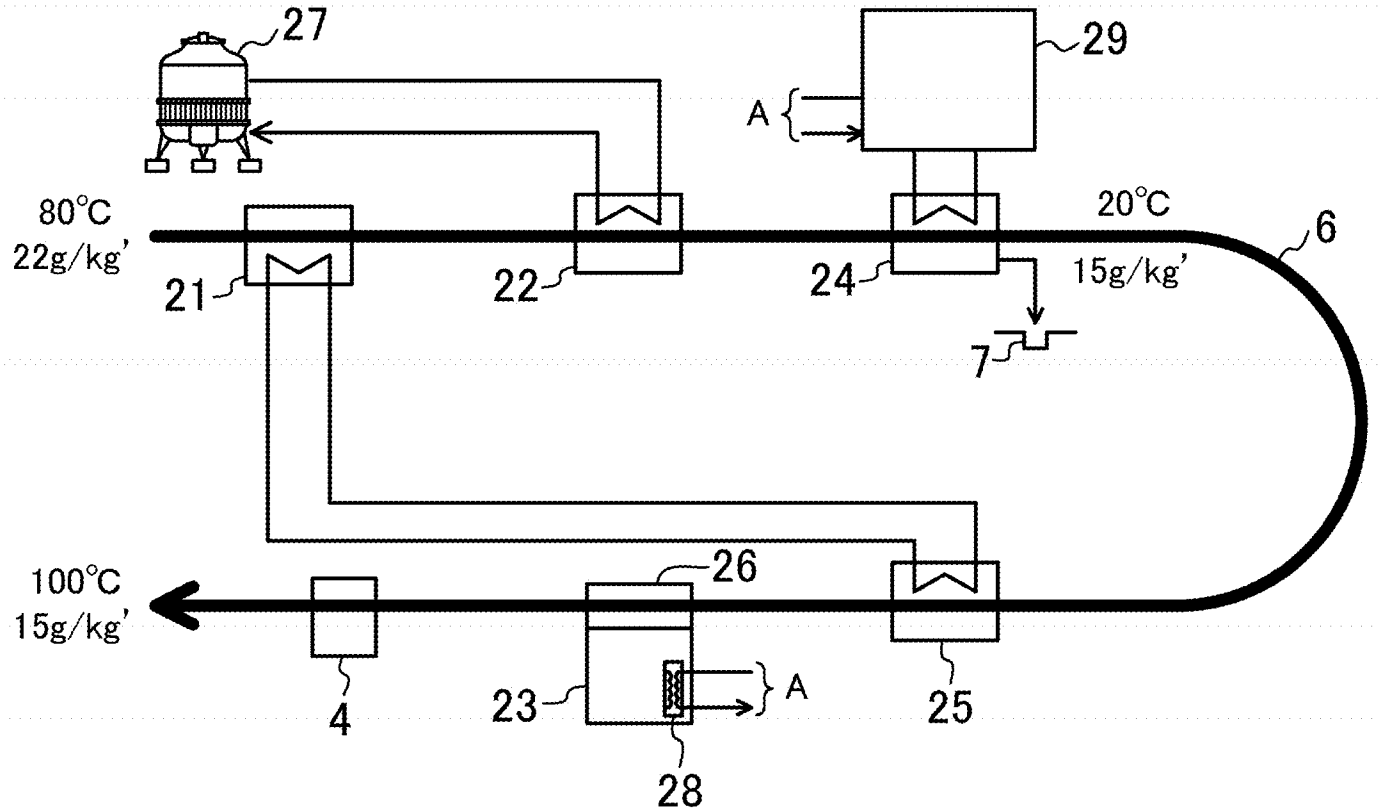
FIG. 3 is a diagram illustrating a cooling and heating system of a coating drying device according to a second embodiment.

FIG. 3 shows a principal part of a coating drying device according to a second embodiment. FIG. 3 shows only a part of a circulation path 6. Though illustration is omitted, as in the first embodiment, the coating drying device includes a drying oven and a circulation fan.

The coating drying device is employed for flash-off. In the circulation path 6 thereof, sequentially from an upstream side toward a downstream side, a first anterior cooler 21, a second anterior cooler 22, a cooler 24 included in a heat pump 23 whose refrigerant is $CO_2$ as in the first embodiment, an anterior heater 25, a heater 26 included in the heat pump 23, and an posterior heater 4 similar to that in the first embodiment are arranged. Accordingly, air taken out from the drying oven 1 is circulated sequentially through the coolers 21, 22, and 24 and the heaters 25, 26, and 4, and is returned into the drying oven 1.

The first anterior cooler 21 and the anterior heater 25 are to perform cooling and heating by heat exchange of the refrigerant and air, respectively, and are configured to circulate the refrigerant between the first anterior cooler 21 and the anterior heater 25. The second anterior cooler 22 cools air sent from the first anterior cooler 21 by heat exchange with cold water obtained in a cooling tower 27.

Cold water cooled by an evaporator 28 of the heat pump 23 is supplied to a cold water tank 29. The cooler 24 cools air sent from the second anterior cooler 22 by heat exchange with cold water sent from the cold water tank 29 by a water feed pump (not shown). In addition, a condenser of the heat pump 23 constitutes the heater 26. The cooler 24 is provided with a tank 7 for storing a condensate liquid produced by cooling of air.

In the above-described configuration, the air taken out from the drying oven is cooled in a stepwise manner by the first anterior cooler 21, the second anterior cooler 22 and the cooler 24 included in the heat pump 23.

In other words, the air taken out from the drying oven is cooled by the first anterior cooler 21 by using cold heat of the air cooled by the cooler 24. For example, when a temperature of the air taken out from the drying oven is 80° C., that air is cooled by the first anterior cooler 21 such that the temperature reaches approximately 60° C. The air cooled by the first anterior cooler 21 is further cooled by the second anterior cooler 22 by cold water obtained in the cooling tower 27 such that the temperature reaches, for example, approximately 40° C.

The air cooled by the second anterior cooler 22 is cooled by the cooler 24 included in the heat pump 23 such that the temperature reaches, for example, approximately 20° C. at which moisture contained in the air, a VOC, and tar components condense. Part of the moisture contained in the air is condensed and removed by this cooling, thereby lowering a weight absolute humidity of the air, for example, such that 22 g/kg of the weight absolute humidity of the air upon being taken out from the drying oven reaches approximately 15 g/kg.

The air cooled by the cooler 24 is heated by the anterior heater 25, the heater 26 included in the heat pump 23, and the posterior heater 4 in a stepwise manner. In other words, the air is heated by the anterior heater 25 such that a temperature thereof reaches approximately 40° C., the air is heated by the heater 26 such that the temperature reaches approximately 80° C., the air is heated by the posterior heater 4 such that the temperature reaches approximately 100° C., and is returned into the drying oven. Since the absolute humidity of this air returned into the drying oven is lowered to approximately 15 g/kg by the previous cooling and agglomeration, dried hot air is supplied to the drying oven.

When a surface temperature of a hanger conveyed into the drying oven is approximately 27° C. to 28° C., upon supplying the air having the absolute humidity of approximately 15 g/kg to the drying oven, a dew-point temperature of the air in the drying oven becomes lower than the surface temperature of the hanger. Thus, dew condensation onto the hanger (dropping of dew condensation water onto a coating film) can be avoided.

In addition, according to the present embodiment, the first anterior cooler 21 and anterior heater 25 are installed and the heat exchange is performed between the air taken out from the drying oven, which has the high temperature, and the air which has passed through the cooler 24, which has the low temperature, thereby enhancing a thermal efficiency. In addition, driving energy of the heat pump 23 serves to heat the circulating air and the second anterior cooler 22 performs the cooling using the cooling tower 27, thereby facilitating the cooling of the air such that the temperature reaches a desired temperature.

Third Embodiment

Figure 4:
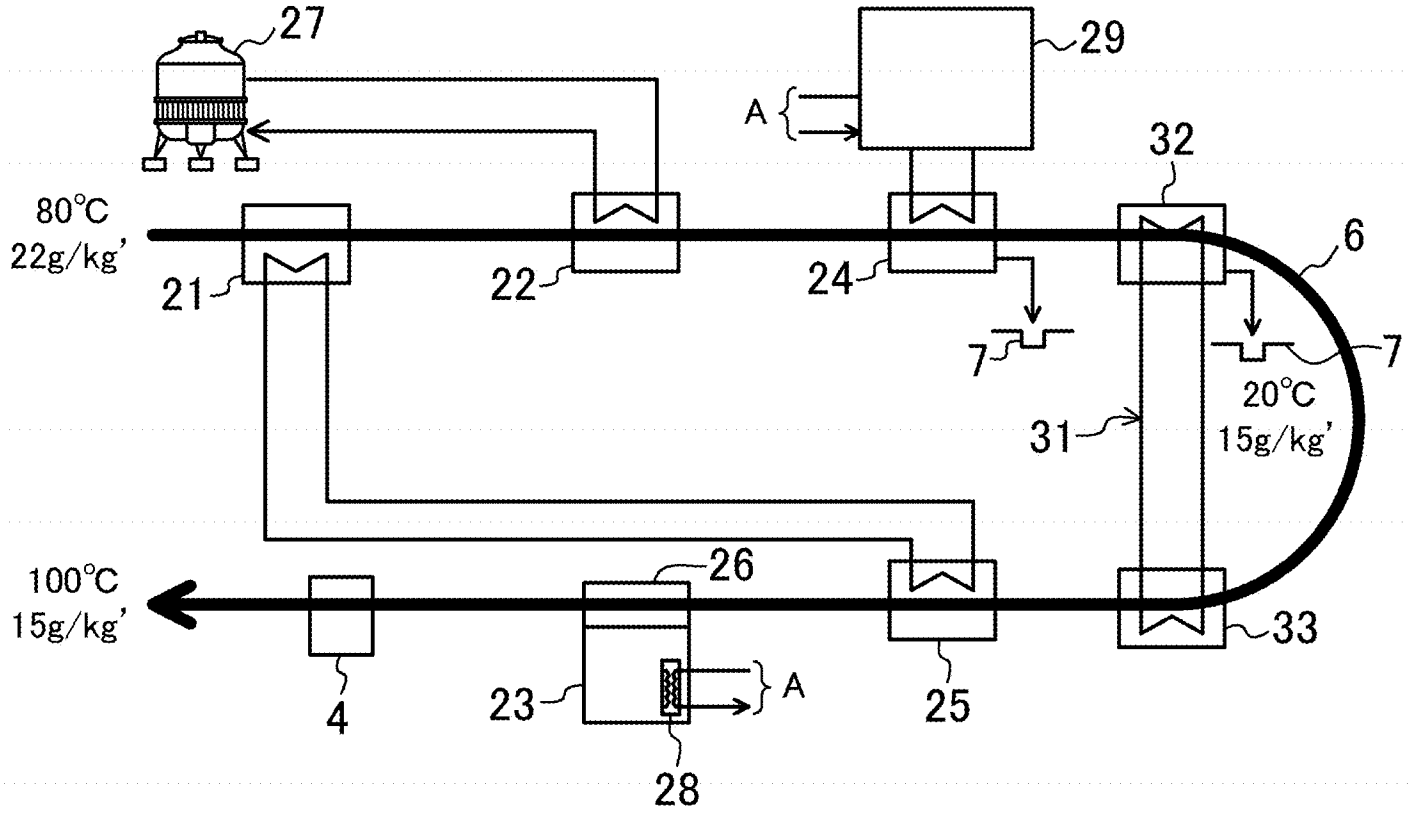
FIG. 4 is a diagram illustrating a cooling and heating system of a coating drying device according to a third embodiment.

FIG. 4 shows a principal part of a coating drying device according to a third embodiment. Although FIG. 4 shows only part of a circulation path 6, as in the first embodiment, the coating drying device includes a drying oven and a circulation fan.

The present embodiment is characterized in that in addition to a heat pump (hereinafter, referred to as a "first heat pump") 23 whose refrigerant is $CO_2$ as in the second embodiment, a second heat pump 31 whose refrigerant is a chlorofluorocarbon medium is used for cooling and heating of air. Other configurations are substantially the same as those of the second embodiment.

In other words, in the circulation path 6, a cooler (hereinafter, referred to as a "first cooler") 24 included in a first heat pump 23 whose refrigerant is the $CO_2$, a second cooler 32 and a second heater 33 which are included in a second heat pump 31 are arranged. Just like the first heat pump 23, the second heat pump 31 is of a vapor compression type which circulates a chlorofluorocarbon medium through a compressor, a condenser, an expansion valve, and an evaporator in this order.

As in the case of the first heat pump 23, cold water cooled by the evaporator of the second heat pump 31 is supplied to a cold water tank, and the second cooler 32 cools the air sent from the first cooler 24 by heat exchange with the cold water in the cold water tank. Note that the cold water tank and a water feed pump are not shown in the drawings. On the other hand, the condenser of the second heat pump 31 constitutes the second heater 33. In addition, a condensate liquid drain is extended from each of the first cooler 24 and the second cooler 32 to the tank 7.

In short, the present embodiment includes a first set configured as the first heat pump 23 which includes the first cooler 24 and a heater (hereinafter, referred to as a "first heater") 26 and whose refrigerant is the $CO_2$, and a second set configured as the second heat pump 31 which includes the second cooler 32 and the second heater 33 and whose refrigerant is the chlorofluorocarbon medium.

Accordingly, the air taken out from the drying oven passes through anterior coolers 21 and 22 and thereafter, the air flows through the first cooler 24 of the first heat pump 23, the second cooler 32 of the second heat pump 31, the second heater 33 of the second heat pump 31, and the first heater 26 of the first heat pump 23 in this order.

This embodiment utilizes the first heat pump 23 whose refrigerant is the $CO_2$ suited for heat absorption and radiation on a high temperature side, and the second heat pump 31 whose refrigerant is the chlorofluorocarbon medium suited for heat absorption and radiation on a low temperature side, thereby efficiently performing the cooling and the heating of the air.

<Others>

The above-described first and second embodiments are employed to perform the flash-off of the coating film. However, the present invention is also applicable to drying for baking the coating film.

In addition, the present invention is not limited to the drying of the coating film of the automobile body, and is also applicable to drying of coating films of other coated articles.

DESCRIPTION OF REFERENCE CHARACTERS

1 Drying Oven
10 Work Piece
3 Heat Pump (Cooler, Heater)
4 Posterior Heater
6 Circulation Path
7 Tank
10 Hanger
21 Anterior Cooler
22 Anterior Cooler
23 Heat Pump (First Heat Pump whose Refrigerant is $CO_2$)
24 Cooler (First Cooler)
26 Heater (First Heater)
31 Second Heat Pump (whose Refrigerant is Chlorofluorocarbon Medium)
32 Second Cooler
33 Second Heater

The invention claimed is:

1. A coating drying method for conveying a coated work piece into a drying oven and drying a coating film of the work piece in the drying oven, the method comprising:

taking out air from the drying oven, and cooling the air such that each of at least part of moisture and at least part of a volatile organic compound (VOC) which are contained in the air is condensed to be removed from the air;

heating the air after the cooling, and returning the heated air into the drying oven, and a heat pump whose heat absorption source is the air taken out from the drying oven and whose heat radiation source is the air after the cooling is provided, and by using the heat pump, the cooling of the air and the heating of the air are performed, the work piece is mounted on a conveyance hanger, and is conveyed into the drying oven, and in the cooling of the air, the moisture contained in the air taken out from the drying oven is condensed to be removed from the air such that a dew-point temperature of the air inside the drying oven becomes equal to or less than a surface temperature of the hanger to be conveyed into the drying oven.

2. The coating drying method of claim 1, wherein the heat pump includes a plurality of the heat pumps, and by using the plurality of heat pumps, the cooling of the air and the heating of the air are performed in a stepwise manner.

3. The coating drying method of claim 2, wherein as the plurality of heat pumps, a first heat pump whose refrigerant is CO2, and a second heat pump whose refrigerant is a chlorofluorocarbon medium are provided, and the cooling of the air is performed in the stepwise manner first by the first heat pump and next by the second heat pump, and the heating of the air is performed in the stepwise manner first by the second heat pump and next by the first heat pump.

4. The coating drying method of claim 1, wherein the air taken out from the drying oven is preliminarily cooled before the cooling by the heat pump.

5. The coating drying method of claim 1, wherein the air heated by the heat pump is further heated, and is returned into the drying oven.

6. A coating drying device for drying a coating film of a coated work piece, comprising:

a drying oven into which the work piece is conveyed;

a cooler into which air from the drying oven is conducted, and which cools the air such that at least part of moisture and at least part of a volatile organic compound (VOC) which are contained in the air are condensed to be removed;

a heater into which the air after the cooling by the cooler is conducted, and which heats the air;

a circulation path which circulates the air inside the drying oven so as to pass from the cooler through the heater and to be returned into the drying oven; and a heat pump which connects the cooler and the heater together, the heat pump supplying cold heat, cooling the air, to the cooler by heat exchange, and which supplies hot heat, heating the air, to the heater by heat exchange, wherein the work piece is mounted on a conveyance hanger, and is conveyed into the drying oven, and the cooler condenses the moisture contained in the air taken out from the drying oven to be removed from the air such that a dew-point temperature of the air inside the drying oven becomes equal to or less than a surface temperature of the hanger to be conveyed into the drying oven.

7. The coating drying device of claim 6, wherein a plurality of sets are provided in the circulation path so as to cause the cooling of the air and the heating of the air to be performed in a stepwise manner, each of the plurality of sets being formed by connecting the cooler and the heater together by the heat pump.

8. The coating drying device of claim 7, comprising, as the plurality of sets, a first set configured as a first heat pump whose refrigerant is CO2 and a second set configured as a second heat pump whose refrigerant is a chlorofluorocarbon medium, wherein both of the first and second sets are provided in the circulation path so as to cause the cooling of the air to be performed in the stepwise manner first by the first heat pump and next by the second heat pump and to cause the heating of the air to be performed in the stepwise manner first by the second heat pump and next by the first heat pump.

9. The coating drying device of claim 6, comprising an anterior cooler provided in the circulation path, cooling the air taken out from the drying oven, and then, conducting the air into the cooler.

10. The coating drying device of claim 6, comprising a posterior heater provided in the circulation path, further heating the air after the heating, and returning the heated air into the drying oven.

* * * * *